US005151404A

United States Patent [19]

Suzuki et al.

[11] Patent Number: 5,151,404

[45] Date of Patent: Sep. 29, 1992

[54] THERMOSENSITIVE RECORDING PAPER

[75] Inventors: Aimi Suzuki, Numazu; Toshiaki Azuma, Mishima; Shigeaki Kimura; Yasuyuki Hosogi, both of Numazu, all of Japan

[73] Assignee: Ricoh Company, Ltd., Tokyo, Japan

[21] Appl. No.: 623,528

[22] Filed: Dec. 7, 1990

[30] Foreign Application Priority Data

Dec. 7, 1989 [JP] Japan ..... 1-316553

[51] Int. Cl.[5] ..... B41M 5/30

[52] U.S. Cl. ..... 503/200; 428/211; 428/537.5

[58] Field of Search ..... 503/200, 226; 427/150-152; 428/537.5, 342, 409, 211

[56] References Cited

U.S. PATENT DOCUMENTS 4,762,816 8/1988 Tamagawa et al. ..... 503/200

*Primary Examiner*—Pamela R. Schwartz

*Attorney, Agent, or Firm*—Oblon, Spivak, McClelland, Maier & Neustadt

[57] ABSTRACT

A thermosensitive recording paper comprising a support sheet and a thermosensitive coloring layer formed thereon, which support sheet comprises needle-leaf tree pulp in an amount ratio of 10 to 50 wt. % of the absolute dry weight of the support sheet, with the maximum length of the fibers in the needle-leaf tree pulp being 4 mm or less.

9 Claims, No Drawings

THERMOSENSITIVE RECORDING PAPER

BACKGROUND OF THE INVENTION

1. Field of the Invention

The present invention relates to a thermosensitive recording paper, and more particularly to a thermosensitive recording paper free from a curling problem even when it is stored in the form of a small roll, which can be properly stacked in a paper tray after thermal recording, and is capable of yielding clear images with high image density by application of a small amount of thermal energy.

2. Discussion of the Background

Various recording materials are conventionally proposed, which utilize a coloring reaction between a colorless or light-colored leuco dye and a color developer under application of heat or pressure.

A thermosensitive recording material, one of the conventional recording materials, has the advantages that it does not necessitate the complicated processes of development and image-fixing, thermal printing can be accomplished in a short time with a relatively simple apparatus, the generation of noise is significantly small in the thermal printing, and the manufacturing cost is low. Because of the aforementioned advantages, the thermosensitive recording material is useful as a recording material for use in electronic computers, facsimile apparatus, ticket vending apparatus and label recorders.

In recent years, as the demand for thermal recording is increasing, a thermal recording apparatus capable of yielding images at a high speed is demanded. As a result, the development of a thermosensitive recording paper which can cope with a high-speed thermal recording apparatus is also desired.

To cope with the high-speed thermal recording, there is a demand for a thermosensitive recording paper which can be brought in close contact with a thermal head of a thermal recording apparatus, thereby improving the efficiency of the heat conduction from the thermal head to the thermosensitive recording paper.

In order to meet the above demand, various methods have been studied and proposed for increasing the surface smoothness of a thermosensitive coloring layer of a thermosensitive recording paper.

For example, Japanese Laid-Open patent application 54-115255 describes that a thermosensitive recording material comprising a thermosensitive coloring layer with a smoothness of 200 to 1000 seconds in terms of Bekk's smoothness can cope only with heat pulses of about 5 to 6 msec, and therefore it is necessary to subject the thermosensitive coloring layer to a surface treatment to obtain a smoothness of 1100 seconds or more in order to meet heat pulses of 1 msec or less for high-speed thermal recording.

However, when the thermosensitive coloring layer of the thermosensitive recording material is subjected to a surface treatment until the Bekk's smoothness thereof attains to 1100 seconds or more, colored fogging takes places in the recording material because of the pressure applied thereto in the course of the surface treatment. To solve the problem of the fogging, the aforementioned application proposes to subject a support sheet for the thermosensitive recording material to a surface treatment to obtain a Bekk's smoothness of 500 seconds or more before the formation of a thermosensitive coloring layer thereon.

However, even though the support sheet of the recording material is subjected to calendering to increase the Bekk's smoothness, when a coating liquid is coated on the support sheet to form a thermosensitive coloring layer thereon, the fibers contained in the support sheet are swollen while in contact with the water contained in the coating liquid, so that the smoothness of the support sheet is decreased. The result is that the surface smoothness of the thermosensitive recording material cannot be substantially improved by the above method.

Japanese Patent Publication 52-20142 discloses a surface treatment method of increasing the Bekk's smoothness of a thermosensitive coloring layer of a thermosensitive recording material up to 200 to 1000 seconds by calendering. This method, however, readily causes a fogging in the thermosensitive coloring layer in the course of the calendering. Furthermore, the non-uniformity of the basis weight of the recording material is intensified and thus it is difficult to bring the recording material into close contact with a thermal head of the thermal recording apparatus. The result is that the image density obtained is decreased.

In Japanese Laid-Open patent application 62-25084, in order to obtain the desired surface smoothness of a thermosensitive recording material, the distribution of the length of the pulp fibers contained in a support sheet of a thermosensitive recording material is specified in such a manner that the residual amount of the pulp sifting through a 24-mesh screen is 10 wt. % or less and the total amount of the residual pulp sifting through the 24-mesh screen and the residual pulp shifting a 42-mesh screen is 60 wt. % or less of the absolute dry weight of the pulp for the support sheet in accordance with a sieve analysis in Japanese Industrial Standards (JIS)-P-8207. The distribution of the fiber length of the pulp contained in the support sheet is thus defined, so that the close contact properties of the thermosensitive recording material to a thermal head can be improved. However, the distribution of the fiber length varies depending on the kind of pulp, so that the distribution of the fiber length in a support sheet cannot necessarily be determined by this method. Therefore, high surface smoothness and uniform texture cannot always be obtained in the support sheet by the above method.

The important requirements for the thermosensitive recording paper includes not only the above-mentioned high thermosensitivity, but also the stacking property of the thermosensitive recording material, which is defined by the property that the thermosensitive recording material cut from a small thermosensitive recording material roll is neatly stacked on a paper tray after being subjected to thermal printing.

To carry out the thermal printing, a small roll of the thermosensitive recording paper is incorporated into a thermal recording apparatus such as a facsimile apparatus. The recording paper is then subjected to the thermal printing as reeled out of the small roll thereof, cut into a predetermined size with a cutter mounted in the apparatus, and then discharged onto a paper tray.

The aforementioned small roll of the thermosensitive recording paper is generally prepared by winding a recording paper having a length of 50 to 100 m around a paper core with a diameter of 30 to 40 mm. The longer the storage time, the more easily the recording paper tends to curl. In addition, the thermosensitive recording paper in the vicinity of the paper core often has a severe curling problem. The curled recording paper causes paper jamming in the thermal printing apparatus and cannot be neatly discharged onto a paper tray.

The aforementioned curling problem of the thermosensitive recording paper is influenced not only by a coating technique for applying a coating liquid for forming a thermosensitive coloring layer on the support sheet, but also by the quality of the support sheet itself. In Japanese Laid-Open patent application 62-23778, in order to reduce the curling tendency, a support sheet comprising a mixture of a natural pulp and a synthetic pulp, with a predetermined stiffness determined by the so-called Clark method, is employed, which stiffness is obtained by bending the sheet in the length direction thereof as defined in JIS P-8143. However, a synthetic pulp is more expensive than wood pulp. In addition, the coating liquid for forming the thermosensitive coloring layer on such a support sheet does not uniformly permeate through the support sheet because the synthetic pulp and the natural pulp are mixed in the support sheet. This has adverse effects on the coloring performance of the thermosensitive recording paper. Moreover, the interaction between the stiffness of the support sheet and the curling problem of the thermosensitive recording paper has not yet been clarified.

In Japanese Laid-Open patent application 60-184875, a support sheet of a thermosensitive recording paper comprises a cationic flexibilizer to prevent the curling problem. However, this attempt does not successfully provide a substantial solution to the curling problem.

In Japanese Laid-Open patent application 61-268482, when a support sheet of a thermosensitive recording paper is prepared by a Yankee paper machine equipped with a drying cylinder, the drying cylinder is preset in such a fashion that the drying conditions at the front side of the support sheet in contact with the drying cylinder are almost the same as those at the back side thereof, and the support sheet is caused to curl in the cross direction (CD) toward the side on which a thermosensitive coloring layer is to be formed. The support sheet is intentionally curled in the cross direction to countervail the curling of the recording paper in the length direction thereof.

However, since the back side of the support sheet is not in contact with the drying cylinder during the preparation thereof and has a low surface smoothness, the drying conditions of a coating liquid for the back side cannot properly be controlled. Consequently, the thus obtained thermosensitive recording paper easily tends to curl in the length direction thereof.

In a thermosensitive recording sheet as disclosed in Japanese Laid-Open patent application 61-14993, the internal binding power of the fibers contained in a support sheet and the water absorption of a fiber node therein are specified. At the same time, the support sheet comprises a bleached kraft pulp of broadleaf tree (LBKP) in an amount of 60 wt. % or more. According to the above-mentioned application, the thermosensitive recording paper thus obtained is capable of yielding images with improved dot-reproduction and high image density. This is because the surface smoothness of the recording paper is improved by containing in the support sheet the bleached kraft pulp of broadleaf tree (LBKP) which essentially consists of short fibers. However, the recording sheet lacks stiffness and the stacking property thereof in a paper tray is not improved.

For the preparation of a support sheet of a thermosensitive recording paper, a pulp, mainly comprising wood pulp, is usually employed, of which beating degree is controlled in terms of the Canadian Standard Freeness (C.S.F.), as defined in JIS P 8121. When the beating degree of the pulp is controlled only by the freeness (C.S.F.), the quality of the support sheets thus prepared greatly scatters and the texture of the support sheet becomes rough. This is because the fibrillating rate of the fibers varies depending on the kind of tree for the pulp, and the unbeaten pulp and unevenness in the fibrillation of fibers cannot be detected when the beating degree of the pulp is determined by the Canadian Standard Freeness (C.S.F.). For these reasons, it is not preferable that the support sheet of the thermosensitive recording paper be prepared by the above method.

SUMMARY OF THE INVENTION

Accordingly, an object of the present invention is to provide a thermosensitive recording paper which does not easily curl even when it is stored in the form of a small roll for a long period of time, and which can properly be stacked in a paper tray after being subjected to a thermal recording operation when the thermosensitive recording paper is mounted in the form of a small roll in a thermal recording apparatus.

Another object of the present invention is to provide a thermosensitive recording paper capable of yielding clear images with high image density.

The above-mentioned objects of the present invention can be achieved by a thermosensitive recording paper comprising a support sheet and a thermosensitive coloring layer formed thereon, which support sheet comprises a needle-leaf tree pulp in an amount ratio of 10 to 50 wt. % of the absolute dry weight of the support sheet, with the maximum length of the fiber in the needle-leaf tree pulp being 4 mm or less.

DESCRIPTION OF THE PREFERRED EMBODIMENTS

Generally, the fiber length of needle-leaf tree pulp is in the range of 2 to 7 mm. When the pulp fibers with a length of 5 mm or more are contained in a support sheet for a thermosensitive recording paper, the surface of the support sheet becomes uneven, which is accompanied by a decrease in the surface smoothness of the recording paper. Therefore, images formed on the above thermosensitive recording paper become unclear and the dot-reproduction performance is insufficient for use in practice. In addition, when the recording paper is subjected to calendering to increase the surface smoothness thereof, a fogging easily occurs in the recording paper.

To increase the surface roughness, thereby solving the above-mentioned problem, a broadleaf tree pulp containing short fibers with a length of 1 to 2 mm is usually used in the support sheet of a thermosensitive recording paper.

A support sheet comprising such a broadleaf tree pulp containing short fibers therein lacks the stiffness defined by the Clark method, although it has the advantages that the texture thereof is smooth and the surface smoothness is high.

The mechanism of the occurrence of the curling of the thermosensitive recording paper has not yet completely clarified. An intensive research conducted by the applicants of the present application indicates that the hydrogen bonds in the pulp cellulose are replaced in the support sheet during an extended storage period, and such replacement causes the curling problem in the recording paper.

Since the broadleaf tree pulp has a wide area in which the aforementioned replacement of hydrogen bonds takes place, the support sheet comprising a large amount of the above broadleaf tree pulp easily curls and it is difficult to eliminate the curling problem.

According to the present invention, with the previously mentioned advantages and disadvantages of the needle-leaf tree pulp and broadleaf tree pulp taken into consideration, the curling problem of a thermosensitive recording paper can be solved, and at the same time, the thermosensitive recording paper capable of yielding clear images can be obtained when a support sheet of the thermosensitive recording paper comprises bleached kraft pulp of needle-leaf tree in an amount ratio of 10 to 50 wt. % of the absolute dry weight of the support sheet, with the maximum length of fiber in the above needle-leaf tree pulp being set at 4 mm or less.

Since the support sheet for use in the present invention comprises the needle-leaf tree pulp in the above-specified range, the area in which the replacement of the hydrogen bonds takes place and the curling problem is caused, can be significantly reduced, with the stiffness of the recording paper maintained adequately. Moreover, the recording paper comprising the above-mentioned support sheet can be subjected to calendering without the fogging being caused in the recording paper as long as the amount of the needle-leaf tree pulp is within the above range.

Since the support sheet for use in the present invention comprises the needle-leaf tree pulp with the maximum length of the fiber therein being 4 mm or less, the surface smoothness of the support sheet becomes equal to, or higher than that of the support sheet which mainly comprises the broadleaf tree pulp. In addition to the above, the surface smoothness of the support sheet for use in the present invention does not decrease during the formation of a thermosensitive coloring layer on the support sheet. This is because the fibers contained in the needle-leaf tree pulp in the support sheet do not swell even when they absorb water in the coating liquid for the thermosensitive coloring layer. Therefore the surface smoothness of the thermosensitive recording paper according to the present invention is high, so that the close contact properties thereof to a thermal head of a thermal recording apparatus are improved and clear images can be thus obtained with high image density.

More preferably in the present invention, the support sheet of the thermosensitive recording paper comprises needle-leaf tree pulp in an amount ratio of 20 to 40 wt. % of the absolute dry weight of the support sheet, with the maximum length of the fiber in the needle-leaf tree pulp being in the range of 2.5 to 3.5 mm to keep the balance between the stiffness of paper and the surface smoothness thereof.

For the needle-leaf tree pulp for use in the support sheet of the present invention, the bleached kraft pulp of the needle-leaf tree is most preferable because the whiteness is extremely high.

The support sheet for use in the present invention may further comprise the broadleaf tree pulp, in particular, bleached kraft pulp of the broadleaf tree. Furthermore, the support sheet may comprise a small amount of synthetic fibers such as polyester; plant fibers such as straw pulp and esparto pulp; and synthetic pulp such as polyolefin.

The pulp for the support sheet for use in the present invention can be obtained by the following beating method.

Namely, the pulp is allowed to stand at a chest for a long time until it spontaneously absorbs water as much as possible to sufficiently swell before being subjected to beating, and the rotational speed of a blade mounted in a refiner is decreased during the beating operation. This is because controlling the fiber length of the pulp only in terms of the Canadian Standard Freeness (C.S.F.) is considered to be impossible.

By selecting an adequate rotational speed of the blade of the conventional refiner and rearranging the beating line for the pulp, the pulp for use in the present invention can be obtained.

It is preferable that the Canadian Standard Freeness (C.S.F.) of the pulp for use in the present invention be in the range or 400 to 300 cc.

For instance, when the pulp was prepared by the conventional beating method so as to obtain the freeness (C.S.F.) of 400 to 300 cc, the pulp thus prepared was found to comprise long fibers with a length of 4.0 mm or more. On the other hand, when the pulp which had been fully caused to swell in the chest was beaten by a refiner with the rotational speed of the blade thereof decreased, the fiber length of the obtained pulp was less than 4.0 mm.

In addition to the above-mentioned pulp, the support sheet for use in the present invention may further comprise additives, such as a sizing agent, a flexibilizer, a stiffness-imparting agent and an anchoring agent for the above sizing agent.

Specific examples of the above sizing agent for use in the present invention include rosin, paraffin wax, salts of higher fatty acids, salts of alkenyl succinic acid, anhydrides of fatty acids, styrene - maleic anhydride copolymers, alkyl ketene dimers and epoxidized fatty amides.

Specific examples of the above flexibilizer for use in the present invention include reaction products of maleic anhydride copolymers and polyalkylene polyamine and quaternary ammonium salts of higher fatty acids.

Specific examples of the above stiffness-imparting agent for use in the present invention include polyacrylamide, starch, polyvinyl alcohol, melamine-formaldehyde condensation products and gelatin.

Specific examples of the above anchoring agent for the above sizing agent include aluminum sulfate and polyamide-polyamine epichlorohydrin.

Furthermore, a pigment, dye, fluorescent dye and antistatic agent may be contained in the formulation of the support sheet of the thermosensitive recording paper according to the the present invention. Of these, the pigment can promote the effect of the present invention, so that the pigment is preferably contained in the formulation of the support sheet in an amount of 10 wt. % or more of the total weight of the pulp.

Moreover, when a filler such as talc is contained in the formulation of the support sheet for use in the present invention, the pulp fibers can effectively be prevented from interlocking, so that the rearrangement of the hydrogen bonding area in the support sheet, which relates to the curling problem of the recording paper, can be reduced.

The thermosensitive recording paper according to the present invention is structured in such a manner that a thermosensitive coloring layer is formed on the above-mentioned support sheet. The thermosensitive coloring layer can be prepared by coating the conventional coating liquid for the thermosensitive coloring layer on the support sheet.

Namely, a solution or dispersion of a thermosensitive coloring material (leuco dye), a color developer such as a phenolic compound and a binder agent is coated on the support sheet and dried to form the thermosensitive coloring layer. The coating solution of dispersion for the thermosensitive coloring layer may further comprise additives such as an anti-foaming agent, surface active agent, wax, clay and inorganic pigment when necessary.

As the leuco dyes for use in the present invention, which are employed alone or in combination, any conventional leuco dyes for use in conventional thermosensitive materials can be employed. For example, triphenylmethane-type leuco compounds, fluoran-type leuco compounds, phenothiazine-type leuco compounds, auramine-type leuco compounds, spiropyran-type leuco compounds and indolinophthalide-type leuco compounds are preferably employed.

Specific examples of those leuco dyes are as follows:

3,3-bis(p-dimethylaminophenyl)-phthalide,
3,3-bis(p-dimethylaminophenyl)-6-dimethylaminophthalide (or Crystal Violet Lactone),
3,3-bis(p-dimethylaminophenyl)-6-diethylaminophthalide,
3,3-bis(p-dimethylaminophenyl)-6-chlorophthalide,
3,3-bis(p-dibutylaminophenyl)-phthalide,
3-cyclohexylamino-6-chlorofluoran,
3-dimethylamino-5,7-dimethylfluoran,
3-(N-methyl-N-isobutylamino)-6-methyl-7-anilinofluoran,
3-(N-methyl-N-isoamylamino)-6-methyl-7-anilinofluoran,
3-diethylamino-7-chlorofluoran,
3-diethylamino-7-methylfluoran,
3-diethylamino-7,8-benzfluoran,
3-diethylamino-6-methyl-7-chlorofluoran,
3-(N-p-tolyl-N-ethylamino)-6-methyl-7-anilinofluoran,
3-pyrrolidino-6-methyl-7-anilinofluoran,
2[N-(3'-trifluoromethylphenyl)amino]-6-diethylaminofluoran,
2-[3,6-bis(diethylamino)-9-(o-chloroanilino)xanthylbenzoic acid lactam],
3-diethylamino-6-methyl-7-(m-trichloromethylanilino)fluoran,
3-diethylamino-7-(o-chloroanilino)fluoran,
3-dibutylamino-7-(o-chloroanilino)fluoran,
3-N-methyl-N-amylamino-6-methyl-7-anilinofluoran,
3-N-methyl-N-cyclohexylamino-6-methyl-7-anilinofluoran,
3-diethylamino-6-methyl-7-anilinofluoran,
3-diethylamino-6-methyl-7-(2',4'-dimethylanilino)fluoran,
3-(N,N-diethylamino)-5-methyl-7-(N,N-dibenzylamino)fluoran,
Benzoyl leuco methylene blue,
6'-chloro-8'-methoxy-benzoindolino-spiropyran,
6'-bromo-3'-methoxy-benzoindolino-spiropyran,
3(2'-hydroxy-4'-dimethylaminophenyl)-3-(2'-methoxy-5'-chlorophenyl)phthalide,
3-(2'-hydroxy-4'-dimethylaminophenyl)-3-(2'-methoxy-4'-nitrophenyl)phthalide,
3-(2'-hydroxy-4'-dimethylaminophenyl)-3-(2'-methoxy-5'-methylphenyl)phthalide,
3-(2'-methoxy-4'-dimethylaminophenyl)-3-(2'-hydroxy-4'-chloro-5'-methylphenyl) phthalide,
3-morpholino-7-(N-propyl-trifluoromethylanilino)fluoran,
3-pyrrolidino-7-trifluoromethylanilinofluoran,
3-diethylamino-5-chloro-7-(N-benzyl-trifluoromethylanilino)fluoran,
3-pyrrolidino-7-(di-p-chlorophenyl)methylaminofluoran,
3-diethylamino-5chloro-7-(α-phenylethylamino)fluoran,
3-(N-ethyl-p-toluindo)-7-(α-phenylethylamino)fluoran,
3-diethylamino-7-(o-methoxycarbonylphenylamino)-fluoran,
3-diethylamino-5-methyl-7-(α-phenylethylamino)fluoran,
3-diethylamino-7-piperidinofluoran,
2-chloro-3-(N-methyltoluidino)-7-(p-n-butylanilino)-fluoran
3-(N-methyl-N-isopropylamino)-6-methyl-7-anilinofluoran,
3-dibutylamino-6-methyl-7-anilinofluoran,
3,6-bis(dimethylamino)fluorenespiro(9,3') -6'-dimethylaminophthalide
3-(N-benzyl-N-cyclohexylamino)-5,6-benzo-7α-naphthylamino-4'-bromofluoran,
3-diethylamino-6-chloro-7-anilinofluoran,
3-N-ethyl-N-(2-ethoxypropyl)amino-6-methyl-7anilinofluoran,
3-N-ethyl-N-tetrahydrofurfurylamino-6-methyl-7-anilinofluoran
3-diethylamino-6-methyl-7-mesidino-4',5'-benzofluoran,
3-(p-dimethylaminophenyl)-3-[1,1-bis(p-dimethylaminophenyl)ethylene-2yl]phthalide,
3-(p-dimethylaminophenyl)-3-[1,1-bis(p-dimethylaminophenyl ethylene-2-yl]-6-dimethylaminophthalide,
3(p-dimethylaminophenyl)-3-(1-p-dimethylaminophenyl1-1-phenylethylene -2-yl)phthalide,
3-(p-dimethylaminophenyl)-3-(1-p-dimethylaminophenyl-1- p-chlorophenylethylene-2-yl)-6-dimethylaminophthalide,
3-(4'-dimethylamino-2'-methoxy)-3-(1''-p-dimethylaminophenyl 1''-p-chlorophenyl-1'',3''-butadiene-4''-yl)benzophthalide,
3-dimethylamino-6-dimethylamino-fluorenone-9-spiro-3'-6'-dimethylamino)phthalide,
3,3-bis[2-(p-dimethylaminophenyl)-2-(p-methoxyphenyl)ethenyl]-4,5,6,7-tetrachlorophthalide,
3bis[1,1-bis(4-pyrrolidinophenyl)ethylene-2-yl]-5, 6-dichloro-4,7-dibromophthalide, and
bis(p-dimethylaminostyryl)-1-naphthalenesulfonylmethane.

As the color developers for use in the present invention, a variety of electron acceptors capable of reacting the above leuco dye under application of heat to induce color formation in the leuco dye, which are conventionally known, such as phenolic compounds, thiophenolic compounds, thiourea derivatives, and organic acids and metallic salts thereof, can be employed Specific examples of such color developers are as follows:

4,4'-isopropylidenebisphenol,
4,4'-isopropylidenebis(o-methylphenol),
4,4'-sec-butylidenebisphenol,
4,4'-isopropylidenebis(2-tert-butylphenol),
4,4'-cyclohexylidenediphenol,
4,4'-isopropylidenebis(2-chlorophenol),
2,2'-methylenebis(4-methyl-6-tert-butylphenol),
2,2'-methylenebis(4-ethyl-6-tert-butylphenol),
4,4'-butylidenebis(6-tert-butyl-2-methylphenol),
1,1,3-tris(2-methyl-4-hydroxy-5-tert-butylphenyl)butane, 1,1,3-tris(2-methyl-4-hydroxy-5-cyclohexylphenyl)butane,
4,4'-thiobis(6-tert-butyl-2-methylphenol),
4,4'-diphenolsulfone,
4-isopropoxy-4'-hydroxydiphenylsulfone,
4-benzyloxy-4'-hydroxydiphenylsulfone,
4,4'-diphenolsulfoxide,
isopropyl p-hydroxybenzoate,
benzyl p-hydroxybenzoate,
benzyl protocatechuate,
stearyl gallate,
lauryl gallate,
octyl gallate,
1,3-bis(4-hydroxyphenylthio)-propane,
1,3-bis(4-hydroxyphenylthio)-2-hydroxypropane,
N,N'-diphenylthiourea,
N,N'-di(m-chlorophenyl)thiourea, salicylanilide,
5-chloro-salicylanilide,
bis(4-hydroxyphenyl)methyl acetate,
bis(4-hydroxyphenyl)benzyl acetate,
1,3-bis(4-hydroxycumyl)benzene,
1,4-bis(4-hydroxycumyl)benzene,
2,4'-diphenolsulfone,
2,2'-diallyl-4,4'-diphenolsulfone,
3,4-dihydroxy-4'-methyldiphenylsulfone,
1-acetyloxy-2-zinc naphthoate,
2-acetyloxy-1-zinc naphthoate,
2-acetyloxy-3-zinc naphthoate,
α,α-bis(4-hydroxyphenyl)-α-methyltoluene, antipyrine complex of zinc thiocyanate, tetrabromobisphenol A, and tetrabromobisphenol S.

In the present invention, a variety of conventional binder agents can be employed for binding the above-mentioned leuco dyes and color developers in the thermosensitive coloring layer to the support sheet.

Examples of the binder agents for use in the thermosensitive coloring layer include water-soluble polymers, for example, polyvinyl alcohol, starch, starch derivatives, cellulose derivatives such as methoxy cellulose, hydroxyethyl cellulose, carboxymethyl cellulose, methyl cellulose and ethyl cellulose, sodium polyacrylate, polyvinyl pyrrolidone, acrylamide - acrylic acid ester copolymer, acrylamide - acrylic acid ester - methacrylic acid terpolymer, alkali salts of styrene - maleic anhydride copolymer, alkali salts of isobutylene - maleic anhydride copolymer, polyacrylamide, sodium alginate, gelatin and casein; emulsions such as polyvinyl acetate, polyurethane, polyacrylic acid ester, polymethacrylic acid ester, vinyl chloride - vinyl acetate copolymer and ethylene - vinyl acetate copolymer; and latexes such as styrene - butadiene copolymer and styrene - butadiene - acrylic acid copolymer.

In addition to the above, various thermofusible materials can be contained as a thermosensitivity-promoting agent in the thermosensitive coloring layer when necessary.

Specific examples of the above thermofusible materials are fatty acids such as stearic acid and behenic acid; fatty amides such as stearic acid amide and palmitic acid amide; metallic salts of fatty acids such as zinc stearate, aluminum stearate, calcium stearate, zinc palmitate and zinc behenate; p-benzylbiphenyl, terphenyl, triphenylmethane, benzyl p-benzyloxybenzoate, β-benzyloxynaphthalene, β-phenyl naphthoate, 1-hydroxy-2-phenyl naphthoate, 1-hydroxy-2-methyl naphthoate, diphenyl carbonate, dibenzyl terephthalate, dimethyl terephthalate, 1,4-dimethoxynaphthalene, 1,4-diethoxynaphthalene, 1,4-dibenzyloxynaphthalene, 1,2-bis(phenoxy)ethane, 1,2-bis(3-methylphenoxy)ethane, 1,2-bis(4-methylphenoxy)ethane, 1,4-bis(phenoxy)butane, 1,4-bis(phenoxy)-2-butene, 1,2-bis(4-methoxyphenylthio)ethane, dibenzoylmethane, 1,4-bis(phenylthio)butane, 1,4-bis(phenylthio)-2-butene, 1,2-bis(4-methoxyphenylthio)ethane, 1,3-bis(2-vinyloxyethoxy)benzene, 1,4-bis(2-vinyloxyethoxy)benzene, p-(2-vinyloxyethoxy)-biphenyl, p-aryloxybiphenyl, p-propargyloxybiphenyl, dibenzoyloxymethane, 1,3-dibenzoyloxypropane, dibenzyl disulfide, 1,1-diphenyl ethanol, 1,1-diphenyl propanol, p-(benzyloxy)benzyl alcohol, 1,3-diphenoxy-2-propanol, N-octadecylcarbamoyl-p-methoxycarbonyl benzene, N-octadecylcarbamoylbenzene, dibenzyl oxalate, and 1,5-bis(p-methoxyphenyloxy)-3-oxapentane.

Further in the present invention, auxiliary additive components which are employed in the conventional thermo-sensitive recording materials, such as a filler and a surface active agent can be employed together with the above-mentioned leuco dyes and color developers.

As the filler for use in the thermosensitive coloring layer, an inorganic filler such as calcium carbonate, silica, zinc oxide, titanium oxide, aluminum hydroxide, zinc hydroxide, barium sulfate, clay, talc, surface-treated calcium and surface-treated silica; and an organic filler such as urea - formaldehyde resin, styrene - methacrylic acid copolymer and polystyrene resin.

Other features of this invention will become apparent in the course of the following description of exemplary embodiments, which are given for illustration of the invention and are not intended to be limiting thereof.

EXAMPLE 1

Preparation of Support Sheet for Use in the Present Invention

The pulp with the formulation as shown in Table 1 was allowed to stand at a chest for 3 hours or more, and then subjected to beating until the freeness (C.S.F.) of the pulp reached 350 cc, using two double-disk type refiners with the rotational speed of a blade thereof being set at 20 m/s or less.

Furthermore, 1.0 part by weight of rosin, 2.0 parts by weight of aluminum sulfate and 10 parts by weight of talc were added to the above prepared pulp per 100 parts by weight of the absolute dry weight of the pulp. Thus, a support sheet No. 1 with a basis weight of 50 g/m$^2$ and a thickness of 60 μm for use in the present invention was prepared by a Fourdrinier paper machine.

EXAMPLE 2

Preparation of Support Sheet for Use in the Present Invention

The pulp with the formulation as shown in Table 1 was allowed to stand at a chest for 3 hours or more, and then subjected to beating until the freeness (C.S.F.) of the pulp reached 380 cc, using one double-disk type refiner and one conical type refiner, with the rotational speed of the blade of the former being being set at 20 m/s or less and that of the latter at 25 m/s or less.

Furthermore, 1.0 part by weight of rosin, 2.0 parts by weight of aluminum sulfate and 11.0 parts by weight of talc were added to the above prepared pulp per 100 parts by weight of the absolute dry weight of the pulp, respectively. Thus, a support sheet No. 2 with a basis weight of 50 g/m$^2$ and a thickness of 60 μm for use in the present invention was prepared by a Fourdrinier paper machine.

COMPARATIVE EXAMPLE 1

Preparation of Comparative Support Sheet

The pulp with the formulation as shown in Table 1 was transported to a chest. Immediately after that, it was subjected to beating until the freeness (C.S.F.) of the pulp reached 350 cc. using one conical-type refiner, with the rotational speed of the blade thereof being set at 30 m/s.

Furthermore, 1.0 part by weight of rosin, 2.0 parts by weight of aluminum sulfate and 1.0 part by weight of talc were added to the above prepared pulp per 100 parts by weight of the absolute dry weight of the pulp.

Thus, a comparative support sheet No. 1 with a basis weight of 50 g/m$^2$ and a thickness of 60 $\mu$m was prepared by a Fourdrinier paper machine.

COMPARATIVE EXAMPLE 2

A sheet of commercially available high quality paper with a basis weight of 50 g/m$^2$ was used as a comparative support sheet No. 2.

The following components were separately grounded and dispersed in a ball mill for 24 hours, so that Liquid A and Liquid B were prepared.

| | Parts by Weight |
|---|---|
| [Liquid A] | |
| Crystal violet lactone | 1.5 |
| 20% aqueous solution of polyvinyl alcohol | 5 |
| Water | 43.5 |
| [Liquid B] | |
| Bisphenol A | 6 |
| 20% aqueous solution of polyvinyl alcohol | 5 |
| Water | 39 |

The thus prepared Liquid A and Liquid B were mixed and stirred, so that a thermosensitive coloring layer coating liquid was obtained.

The above thermosensitive coloring layer coating liquid was coated on one side of each of the above prepared support sheets by a wire bar in a deposition amount of about 3 g/m$^2$ (solid components) and dried, thereby forming a thermosensitive coloring layer on each support sheet. Each thermosensitive coloring layer was subjected to calendering, whereby thermosensitive recording papers were obtained.

Using a commercially available thermal printing apparatus made by Matsushita Electronic Components Co., Ltd., thermal printing was performed on each of the above prepared thermosensitive recording papers with application of a voltage of 13.3 V. The image density of the obtained images was measured by a Mcbeth densitometer RD-914.

Moreover, each thermosensitive recording paper was incorporated in a commercially available facsimile apparatus "RIFAX $\alpha$-20" (Trademark), made by Ricoh Company Ltd., in the form of a small roll. After receiving data of 30 sheets, the stacking performance of the recording paper in a paper tray was checked. The results are shown in Table 1.

TABLE 1

| | Support Sheet | | Comparative Support Sheet | |
|---|---|---|---|---|
| | No. 1 | No. 2 | No. 1 | No. 2 |
| Incorporated ratio of N:L* (wt. %) | 30:70 | 20:80 | 30:70 | L:100 |
| Maximum fiber length of N (mm) | 3.2 | 3.0 | 5.0 | L:1.0 |
| Image density of obtained images | 1.35 | 1.36 | 1.28 | 1.34 |
| Stacking in paper tray** | 0 | 0 | 12 | 19 |

*N: Bleached kraft pulp of needle-leaf tree (NBKP)
L: Bleached kraft pulp of broadleaf tree (LBKP)
**The stacking in a paper tray was expressed by the number of the thermosensitive recording papers which were not properly stacked in the paper tray while 30 sheets of the recording paper were discharged from the facsimile apparatus.

As can be seen from the results shown in Table 1, the thermosensitive recording papers according to the present invention can yield images with high image density, without the curling problem.

What is claimed is:

1. A thermosensitive recording paper comprising a support sheet and a thermosensitive coloring layer formed thereon, said support sheet comprising a needle-leaf tree pulp comprising fibers, in an amount of 10 to 50 wt. % of the absolute dry weight of said support sheet, with the maximum length of said fibers of said needle-leaf tree pulp being 4 mm or less.

2. The thermosensitive recording paper as claimed in claim 1, wherein said needle-leaf tree pulp contained in said support sheet is a bleached kraft pulp of needle-leaf tree.

3. The thermosensitive recording paper as claimed in claim 1, wherein said needle-leaf tree pulp has a Canadian Standard Freeness in the range or 400 to 300 cc.

4. The thermosensitive recording paper as claimed in claim 1, wherein said support sheet further comprises at least one component selected from the group consisting of a sizing agent, a flexibilizer, a stiffness-imparting agent, an anchoring agent for said sizing agent, a pigment, a dye, an antistatic agent and a filler.

5. The thermosensitive recording paper as claimed in claim 4, wherein said sizing agent is selected from the group consisting of rosin, paraffin wax, salts of higher fatty acids, salts of alkenyl succinic acid, anhydrides of fatty acids, styrene - maleic anhydride copolymers, alkyl ketene dimers and epoxidized fatty amides.

6. The thermosensitive recording paper as claimed in claim 4, wherein said flexibilizer is selected from the group consisting of reaction products of maleic anhydride copolymers and polyalkylene polyamine, and quaternary ammonium salts of higher fatty acids.

7. The thermosensitive recording paper as claimed in claim 4, wherein said stiffness-imparting agent is selected from the group consisting of polyacrylamide, starch, polyvinyl alcohol, melamine-formaldehyde condensation products and gelatin.

8. The thermosensitive recording paper as claimed in claim 4, wherein said anchoring agent for said sizing agent is selected from the group consisting of aluminum sulfate and polyamidepolyamine epichlorohydrin.

9. The thermosensitive recording paper as claimed in claim 4, wherein said pigment is contained in the formulation of said support sheet in an amount of 10 wt. % or more of the total weight of the pulp.

* * * * *

UNITED STATES PATENT AND TRADEMARK OFFICE

CERTIFICATE OF CORRECTION

PATENT NO. : 5,151,404

DATED : SEPTEMBER 29, 1992

INVENTOR(S) : AIMI SUZUKI ET AL

It is certified that error appears in the above-identified patent and that said Letters Patent is hereby corrected as shown below:

Column 8, line 5, after "3-diethylamino-5", insert -- - --;
line 20, after "5,6-benzo-7", insert -- - --;
line 23, after "amino-6-methyl-7", insert -- - --;
line 30, after "ethylene-2", insert -- - --;
line 32, after "thylaminophenyl", insert --)--;
line 35, "phenyll" should read --phenyl--
line 40, after "thylaminophenyl", insert -- - --;
line 43, after "3′-", insert --(--;
line 46, after "3", insert -- - --.
line 56, after "employed", insert --.--; and starting with "Specific", start a new paragraph;

Column 11, line 59, delete "Mcbeth", insert --McBeth--.

Signed and Sealed this

Twenty-second Day of March, 1994

*Attest:*

BRUCE LEHMAN

*Attesting Officer*

*Commissioner of Patents and Trademarks*